US006779237B1

(12) United States Patent
Stoltenberg

(10) Patent No.: US 6,779,237 B1
(45) Date of Patent: Aug. 24, 2004

(54) NECKLACE AND METHOD OF MANUFACTURE

(76) Inventor: Linda Stoltenberg, 1417 Union Ave., Baltimore, MD (US) 21211

( * ) Notice: Subject to any disclaimer, the term of this patent is extended or adjusted under 35 U.S.C. 154(b) by 0 days.

(21) Appl. No.: 10/684,729

(22) Filed: Oct. 14, 2003

(51) Int. Cl.[7] ..... A44C 27/00
(52) U.S. Cl. ..... 28/149; 28/143; 28/153
(58) Field of Search ..... 28/143, 149, 147, 28/146, 153, 145, 140, 144, 151, 163, 170, 171; 223/44, 46; 63/3, 33, 35

(56) References Cited

U.S. PATENT DOCUMENTS

| | | | | | |
|---|---|---|---|---|---|
| 113,748 | A | | 4/1871 | Dexter | |
| 1,268,500 | A | * | 6/1918 | Schlegel | 28/147 |
| 1,361,055 | A | * | 12/1920 | Henry | 28/149 |
| 1,978,168 | A | | 10/1934 | Reid | 63/3 |
| 2,089,755 | A | * | 8/1937 | Merwitz | 28/149 |
| 2,317,914 | A | * | 4/1943 | McIntyre | 28/147 |
| 2,322,060 | A | * | 6/1943 | Samuels | 28/147 |
| 3,377,674 | A | * | 4/1968 | Brassaw et al. | 28/147 |
| 3,833,157 | A | * | 9/1974 | Lofton | 223/46 |
| 3,854,179 | A | * | 12/1974 | Montoya | 28/147 |
| 3,879,823 | A | * | 4/1975 | Lamb | 28/147 |
| 4,032,052 | A | * | 6/1977 | Bates, Jr. | 223/46 |
| 5,299,719 | A | * | 4/1994 | Newgas | 223/46 |
| 5,720,049 | A | | 2/1998 | Clutton | 2/207 |
| 5,896,756 | A | * | 4/1999 | Watkins | 63/3 |
| 5,997,966 | A | * | 12/1999 | Sadur | 28/147 |

* cited by examiner

*Primary Examiner*—Amy Brooke Vanatta
(74) *Attorney, Agent, or Firm*—Goldstein Law Offices, PC.

(57) ABSTRACT

A necklace for wearing around a wearer's neck. The necklace is constructed from a number of strands of woven yarn. The strands are wrapped together, capped at each end, and frayed at various positioned between the ends in order to create the unique appearance of the necklace.

1 Claim, 4 Drawing Sheets

NECKLACE AND METHOD OF MANUFACTURE

BACKGROUND OF THE INVENTION

The invention relates to a necklace and a method of manufacturing the necklace. In particular, the invention is a necklace comprising a plurality of woven strands of yarn that are secured together at both ends. Select individual strands of the yarn are frayed to create a wispy feathery necklace that is worn around a person's neck.

Jewelry is enjoyed and worn by women of all ages. While different styles of jewelry come in and out of fashion, the most popular pieces are necklaces, bracelets, and earrings. Necklaces in particular are often chosen to compliment a particular outfit. A clasp is typically positioned at each end of the necklace and is fastened in the back of the wearer's neck.

Numerous types of necklaces are known, namely lariat necklaces, chokers, chain or link necklaces, drop necklaces, and charm or solitaire necklaces. Each piece is typically chosen according to the outfit being worn, particularly to accent the neckline of the wearer's shirt or blouse. The necklace is intended to create a flattering and complimentary look for the wearer.

In an effort to have a unique sense of style and fashion, there is always a desire to create a new necklace that will revolutionize fashion. The strand necklace is constructed from a plurality of strands of woven yarn that are intertwined and secured at both ends with a fastening clasp. The necklace is chosen by a wearer according to the colors of the yarn utilized, as well as the desired length of the necklace.

Various accessories are available that employ pieces of fabric. By way of example, U.S. Pat. No. 5,720,049 to Clutton discloses a scarf that comprises one or more pieces of fabric that are gathered and releasably held together at the ends. U.S. Pat. No. 1,978,168 to Reid discloses a bracelet constructed from animal fur. U.S. Pat. No. 113,748 to Dexter discloses a scarf comprises a plurality of strands and a double fringe band.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved necklace and method of manufacture. As such, the general purpose of the present invention, which will be described subsequently in greater detail, is to provide a new and improved necklace which has all the advantages of the prior art and none of the disadvantages.

To attain this, the present invention essentially comprises a necklace for wearing around a wearer's neck. The necklace is constructed from a number of strands of woven yarn. The strands are wrapped together and capped at each end in order to create the unique appearance of the necklace.

It is an object of the invention to produce a necklace that is inexpensively manufactured with regard to both materials and labor, and which is then susceptible of low prices of sale to the consuming public. Accordingly, the necklace comprises a plurality of woven strands of yarn that are bound together at either end.

It is another object of the present invention to provide a new and improved necklace which may be easily and efficiently manufactured and marketed.

It is a further object of the present invention to provide a necklace having a durable and reliable construction.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
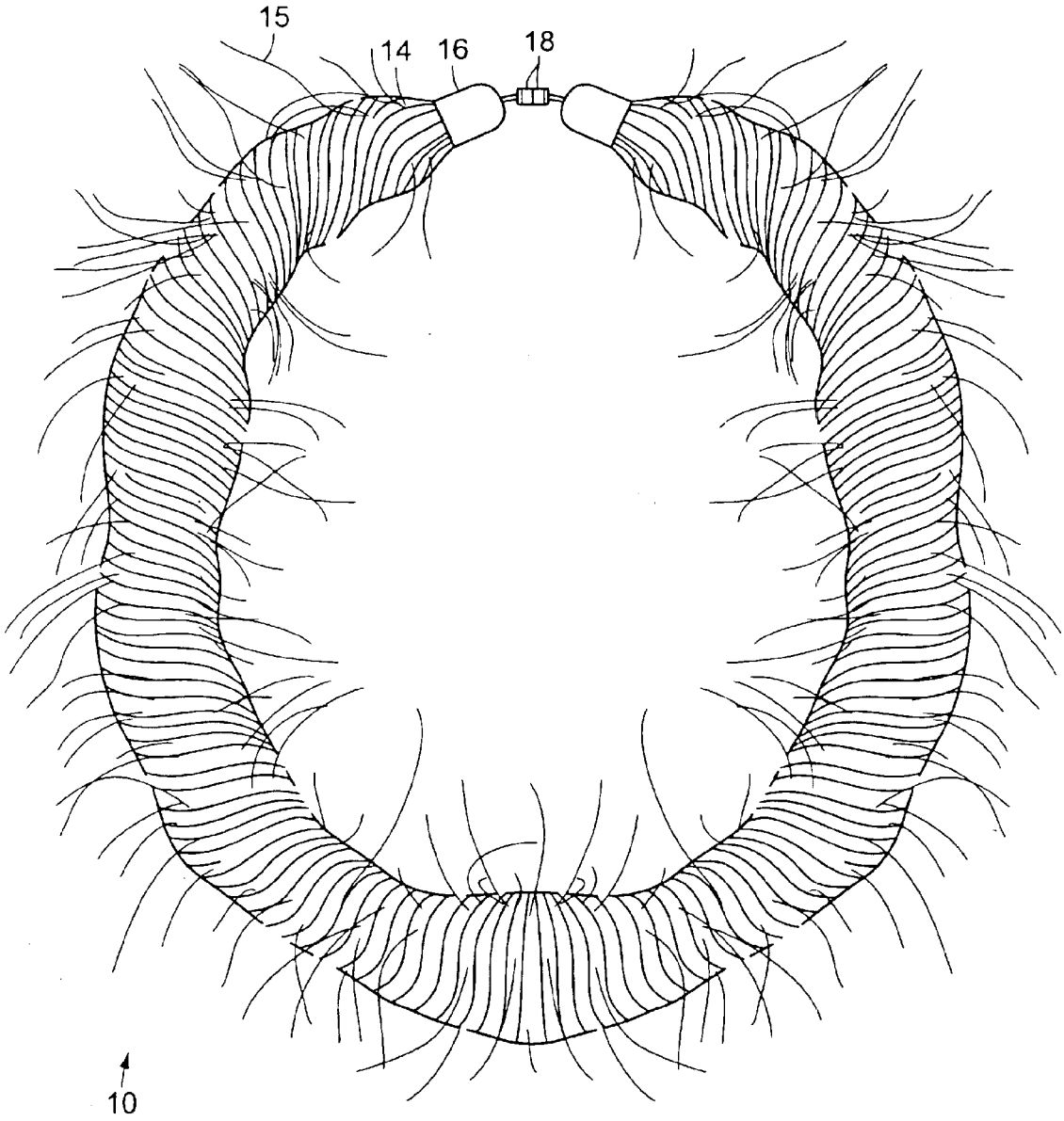
FIG. 1 is a perceptive view of the necklace.
Figure 2:
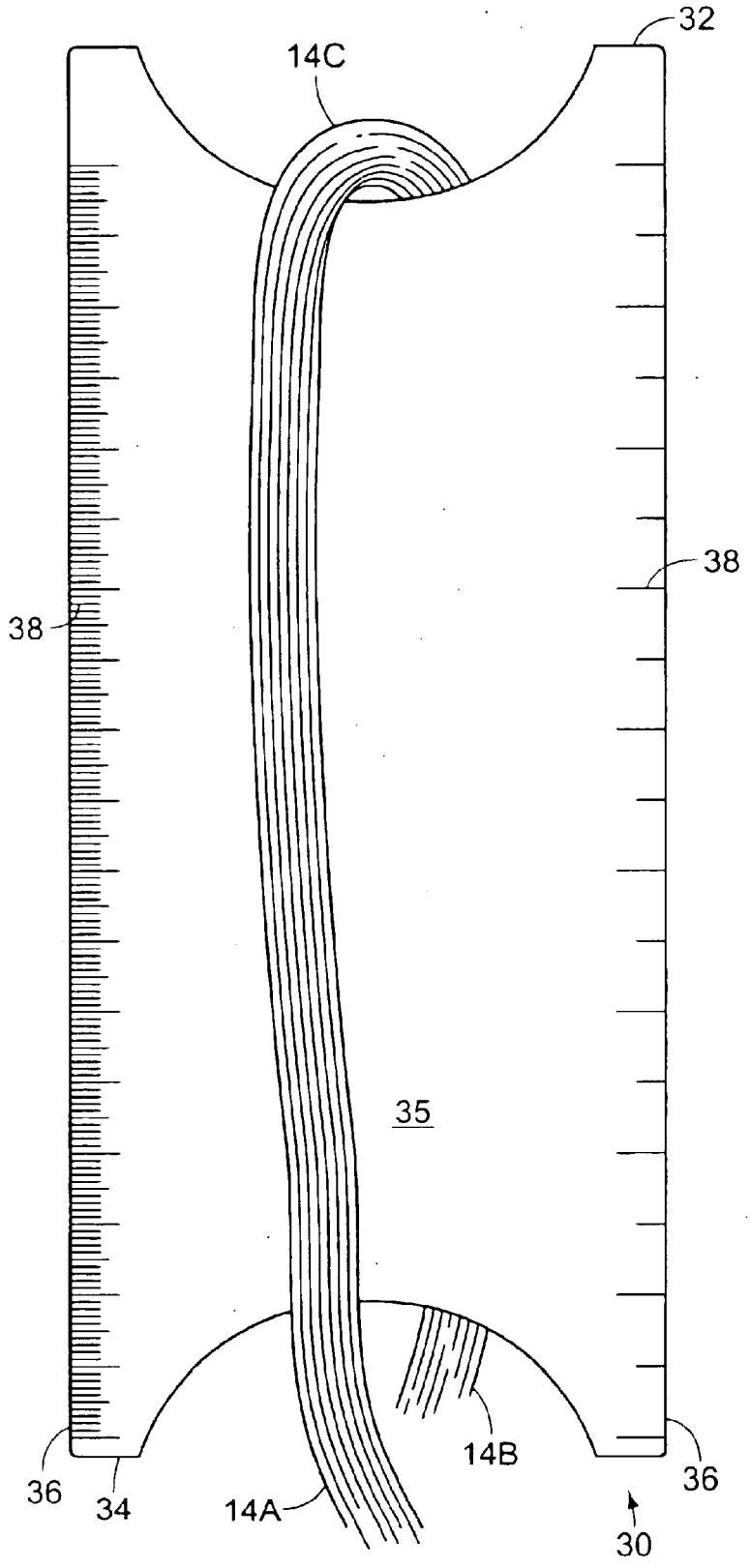
FIG. 2 is a front elevational view of a jig having strands of yarn thereon, illustrating the manufacture of the necklace.

10 necklace
12 neck
14 strand
14A strand first end
14B strand second end
14C strand middle portion
15 strand filament
16 cap
18 clasp portion
30 jig
32 jig top end
34 jig bottom end
35 jig top surface
36 jig side edge
38 jig line
40 jig cut away portion

DETAILED DESCRIPTION OF THE PREFERRED EMBODIMENTS

FIG. 1 illustrates a necklace 10 that is intended to be worn around a wearer's neck 12. The necklace 10 essentially comprises a plurality of strands 14 of woven yarn, wherein the strands 14 are wrapped together, capped, and frayed at various positions between the ends in order to create the unique appearance of the necklace 10. Each strand 14 of the necklace 10 has a pair of opposed ends, namely a first end 14A and a second end 14B, and a middle portion 14C extending between the ends 14A, 14B, each strand 14 also is comprised of a plurality of filaments 15.

The strands 14 utilized in the manufacture of the necklace 10 may be of any color or fabric, according to the user's preference. By way of example, the necklace 10 may be constructed from different shades of one color, a mixture of different colors, or a single color. Any type of yarn may be employed, namely cotton, poly cotton blend, angora, cashmere, or wool. Further, although the number of strands 14 used may vary according to the desired thickness of the necklace 10, typically sixty to seventy-five (60–75) yards of yarn are employed for each necklace 10.

Figure 3:
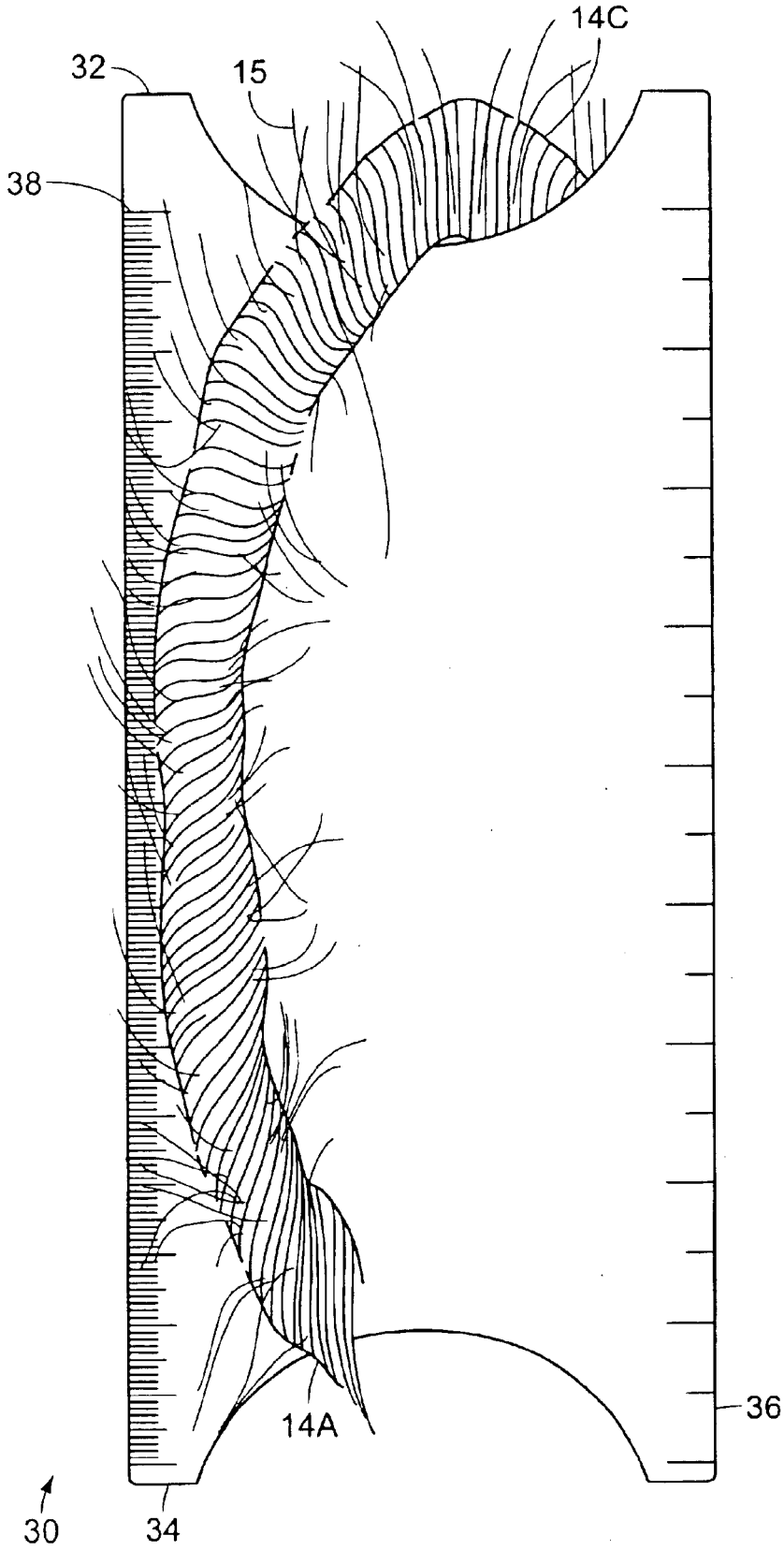
FIG. 3 is a front elevational view of the jig with the wrapped strands positioned thereon.

A jig 30 is employed in the manufacture of the necklace 10, as illustrated in FIG. 3. While any type of jig 30 may be utilized, for illustration purposes only, an elementary jig 30 comprising a flat continuous length of material, namely plexiglass, is shown. The jig 30 has a top end 32, a bottom end 34, a pair of opposed side edges 36 extending therebetween, and a top surface 35. Incremental lines 38 extend inward at the side edges 36, on the top surface 35, from the top end 32 to the bottom end 34. These incremental lines 38 represent lengths, namely centimeters on one side, and inches on the opposite side. A cut away portion 40 is positioned at either end 32, 34 of the jig 30 for supporting the strand middle portions 14C.

In order to produce the configuration of the necklace 10, the desired colored strands 14 are chosen. The strands 14 are then cut to size according to the preferred length of the necklace 10. By way of example, the necklace 10 may be manufactured in a variety of lengths to offer a variety of sizes, namely eighteen (18") inches, twenty-two (22") inches, thirty (30") inches, or thirty-six (36") inches. Once the appropriate length is determined, the strands 14 are wrapped around the jig 30, with the opposed strand ends 14A, 14B dangling towards the jig bottom end 34. The middle portions 14C of the strands 14 are supported by the cut away portions 40 of the jig 30, thereby keeping the strands 14 in place over the jig 30. The strand ends 14A, 14B are then wrapped until the entire length of the strands 14 are wrapped together, as illustrated in FIG. 3.

Figure 4:
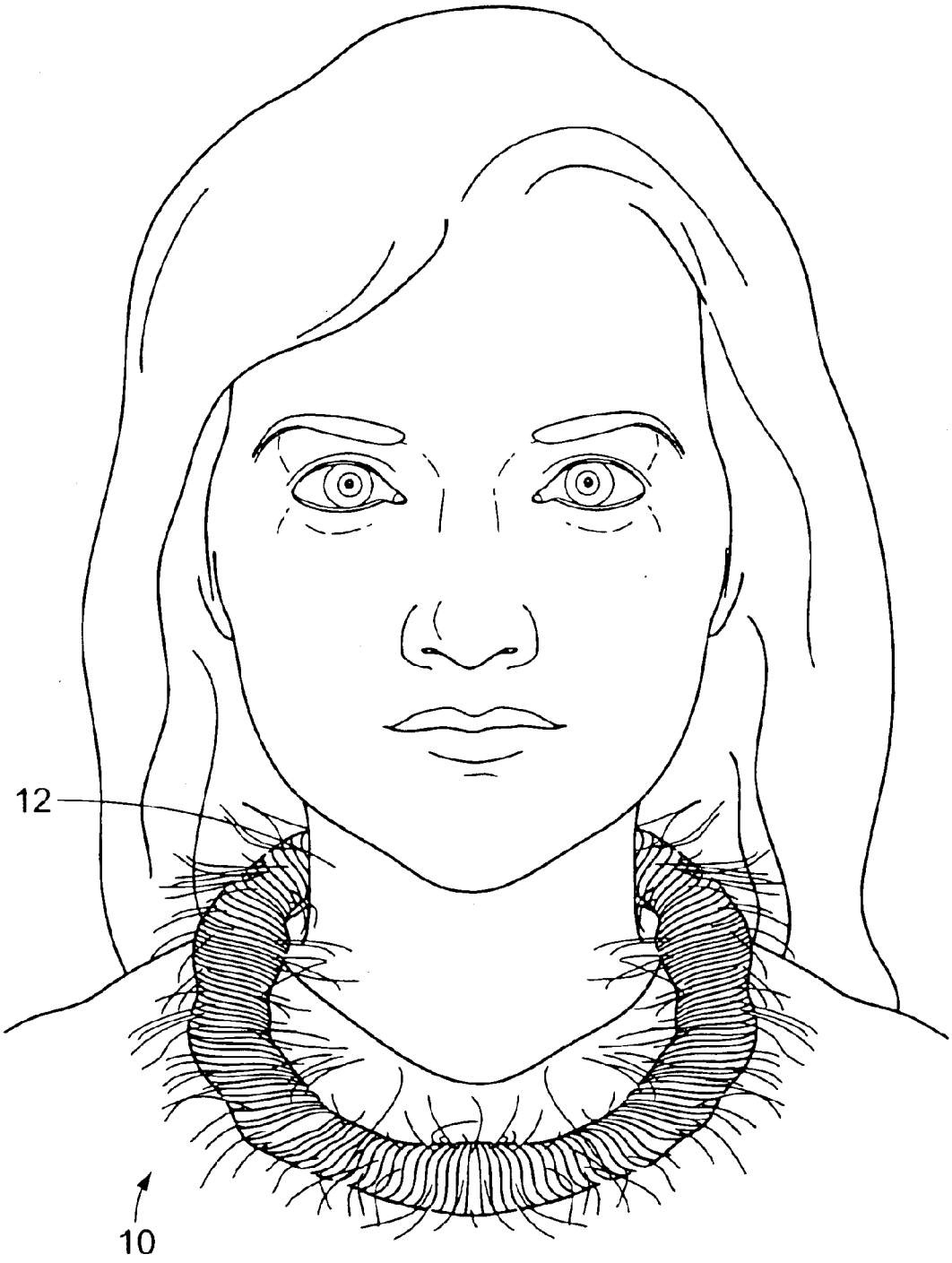
FIG. 4 is a perspective view of necklace being worn around a person's neck.

The plurality of strand ends 14A, 14B are then secured together with a cap 16. Once all strands 14 are secured, individual filaments 15 from various strands 14 are selectively frayed at various positions along the strand 14 to create a frayed appearance, as seen in FIGS. 1 and 4. Care must be taken to ensure that at least one filament 15 from each strand 14 is not severed and continues to extend between the caps 16. The number of filaments 15 pulled depends on the individual's preference. A clasp portion 18 is then secured to each cap 16, wherein the clasp portions 18 are selectively mateable in order to connect the first and second: ends 14A, 14B of the necklace 10. When properly fastened around the wearer's neck 12, the clasp portions 18 are secured around the back of the wearer's neck 12.

In conclusion, herein is presented a necklace constructed from strands of woven yarn to be worn around a wearer's neck. The invention is illustrated by example in the drawing figures, and throughout the written description. It should be understood that numerous variations are possible, while adhering to the inventive concept. Such variations are contemplated as being a part of the present invention.

What is claimed is:

1. A method of manufacturing a necklace, the method utilizing a jig, the jig comprising a top end, a bottom end, and a pair of cut away portions at jig ends, the necklace comprising a plurality of strands of woven yarn, each strand having a pair of opposed ends, a middle portion extending between the ends, and a plurality of filaments, comprising the steps of;

choosing the strands to be utilized in the necklace according to the desired colors and fabrics;

cutting the lengths of the strands to size according to the desired length of the necklace;

wrapping the strands of yarn around the jig by placing the strand middle portions around the jig cut away portions and dangling the strand ends toward the jig bottom end;

wrapping the strand ends until the entire length of the strands are intertwined together;

securing the wrapped strand ends together by securing the ends with a cap;

fraying individual filaments from various strands at various positions along the strands to create a frayed appearance;

fastening a clasp portion to each cap;

mating the clasp portions in order to connect the first and second ends of the necklace; and fastening the necklace around the wearer's neck.

* * * * *